US007097076B1

(12) United States Patent
Giblin et al.

(10) Patent No.: US 7,097,076 B1
(45) Date of Patent: Aug. 29, 2006

(54) FITMENT AND BOTTLE

(75) Inventors: Edward John Giblin, Hopatcong, NJ (US); Corinne Saso, Ridgefield Park, NJ (US); George Albright, Rutherford, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 1283 days.

(21) Appl. No.: 09/686,325

(22) Filed: Oct. 11, 2000

(51) Int. Cl.
*B67D 1/16* (2006.01)

(52) U.S. Cl. ..... 222/109; 222/111; 222/569; 222/570; 222/571; 222/465.1

(58) Field of Classification Search ..... 222/109, 222/111, 478–479, 481, 481.5, 482, 392, 222/465.1, 566–572; 215/343–345, 307
See application file for complete search history.

(56) References Cited

U.S. PATENT DOCUMENTS

| | | | | |
|---|---|---|---|---|
| 3,217,935 | A | | 11/1965 | Burt |
| 3,610,455 | A | * | 10/1971 | Greenhalgh ..... 222/325 |
| 4,298,145 | A | | 11/1981 | Iida |
| 4,550,862 | A | | 11/1985 | Barker et al. |
| 4,671,421 | A | | 6/1987 | Reiber et al. |
| 4,696,416 | A | | 9/1987 | Muckenfuhs et al. |
| 4,706,829 | A | | 11/1987 | Li |
| 4,773,560 | A | | 9/1988 | Kittscher |
| 4,830,234 | A | | 5/1989 | Odet |
| 4,890,770 | A | | 1/1990 | Haga et al. |
| 4,917,269 | A | | 4/1990 | Fuchs et al. |
| 5,058,772 | A | | 10/1991 | Moore et al. |
| 5,108,009 | A | | 4/1992 | Davidson et al. |
| 5,131,566 | A | | 7/1992 | Bavegems |
| 5,251,788 | A | | 10/1993 | Moore |
| 5,431,306 | A | | 7/1995 | Reid |
| 5,435,467 | A | | 7/1995 | Ekkert et al. |
| 5,462,202 | A | | 10/1995 | Haffner et al. |
| 5,566,862 | A | * | 10/1996 | Haffner et al. ..... 222/111 |
| 5,855,299 | A | * | 1/1999 | Arnold et al. ..... 222/109 |
| 5,868,283 | A | | 2/1999 | Wilson et al. |
| 6,045,013 | A | * | 4/2000 | Yang ..... 222/481.5 |

FOREIGN PATENT DOCUMENTS

CA 2 225 949 6/1998

OTHER PUBLICATIONS

PCT International Search Report.
PCT International Preliminary Examination Report.

* cited by examiner

*Primary Examiner*—Frederick C. Nicolas
(74) *Attorney, Agent, or Firm*—Milton L. Honig

(57) ABSTRACT

A container including a fitment having an outer wall and a pour spout. The fitment outer wall includes a first product exit aperture. A bottle finish includes one or more locking surfaces abutting the outer wall of the fitment, and the finish locking surface includes a channel which directs product trapped between the outer wall of the fitment and the inner wall of the finish to the first product exit aperture and then to the exterior of the container or directly to the exterior of the container. This permits egress of residual drops of product from the container. Alternatively, the channel can extend to the top of the finish.

32 Claims, 8 Drawing Sheets

FITMENT AND BOTTLE

BACKGROUND OF THE INVENTION

Heavy duty liquid detergent products have grown in popularity over recent years. The sale of such products in specialized dispensing packages, usually including a combined measuring cup/closure, and a drainback fitment/spout has aided the consumers in the use of such products.

While drainback containers have enhanced the convenience of the use of heavy duty liquid detergents and other products, still some problems exist. Many of the containers include fitments which extend well below the top of the container finish into the bottle. The problem which this presents is that it is sometimes difficult to pour out from the container the last remnants of product since product becomes entrapped between the fitment and the container finish when the bottle is in the inverted, pouring position. This is particularly a problem for "see-through" containers, which can be expected to maximize consumer frustration with the inability to utilize the entire product present within the container.

Barker et al., U.S. Pat. No. 4,550,862 discloses a dispenser package which includes a transition collar having an extended pour spout and a transverse partition with a drain to collect and return residual liquid to the container. A measuring cup has an open mouth with threads on its exterior to attach to the cup on the interior of the transition collar. The measuring cup acts as a closure for the package. The bottle finish has external threads that mate with internal threads on the transition collar.

Muckenfuhs et al., U.S. Pat. No. 4,696,416 is directed to a package similar to that of Barker et al. except that a drip concentrating member is present in the lowermost surface of the drainback partition.

Davidson et al., U.S. Pat. No. 5,108,009 discloses a package having a spout-containing fitment wherein external threads on the package finish cooperate with internal threads on a closure/measuring cup. The Davidson et al. bottle includes a locking circumferential ridge on an inner peripheral surface of the upper end portion of the bottle finish (see FIGS. 9 and 10), which retains the fitment.

The Davidson et-al. design is embodied in heavy-duty liquid detergent containers sold by Lever Brothers Company for products such as Surf and Wisk® detergents, sold for over one year in the U.S. The fitment of these commercially available containers includes, in addition to a drainback opening, an opening in the sidewall of the fitment to permit liquid entrapped between the wall of the fitment and the container finish to exit the container. While this arrangement has improved the ability to dispense more of the product, there is still a need to minimize further the loss of product to the consumer when liquid is trapped between the wall of the fitment and the finish of the container.

CA 2225949 discloses a bottle having a fitment with a spout. It is said that more than one product exit aperture may be present and that the product exit aperture also serves as a vent hole. The product exit aperture is said to be located high enough in the fitment wall such that at least a portion of liquid trapped when the bottle is turned upside down can escape. It may be positioned halfway down the wall of the fitment, or one quarter of the way down or three quarters of the way down or elsewhere.

Kittscher, U.S. Pat. No. 4,773,560 discloses a measuring cup closure for a container. The closure has a spout part which is placeable in the container opening, a pouring spout and an outer ring formed integrally around the base of the spout part. The closure also includes a measuring cup. In order to ensure that product draining from the measuring cup after it has been used is able to flow back into the interior of the container, an outlet preferably in the form of a slot 17 extends substantially parallel to the axis 1 of the container opening 2 is provided in the outer ring 8 at the base 15 of the outer ring or at the lowest point of the region 16 between the pouring spout 7 and its outer ring 8. A thread gap 22 at the outer end of outer screw thread 4 forms a stop for alignment of the spout part.

The Kittscher patent also states, more generally, that when the spout part projects into the container as is preferably the case, a slot extending substantially parallel to the axis of the container opening is provided in the outer ring of the spout part opposite the pouring side of the spout. The remaining product can be poured out through this slot when the container is held upside down.

Ekkert et al., U.S. Pat. No. 5,435,467 is directed to a container having an externally threaded finish which mates with an internally threaded finish of a closure. A fitment having a radially extending flange is inserted within the mouth of the container and the radially extending flange rests upon the top of the finish. The arrangement is such that the amount of residual contents left within the container is said to be diminished. The illustrated spout fitment appears to have substantial areas open for product to flow through, relative to the area defined by the outer spout wall.

Other bottle patents include Li, U.S. Pat. No. 4,706,829, Burt, U.S. Pat. No. 3,217,935, Iida, U.S. Pat. No. 4,298,145 and Odet, U.S. Pat. No. 4,830,234.

The following discloses bottles and/or spouts: Bavegems, U.S. Pat. No. 5,131,566, Moore, U.S. Pat. No. 5,251,788, Haga et al., U.S. Pat. No. 4,890,770, Haffner et al., U.S. Pat. No. 5,462,202, Fuchs et al., U.S. Pat. No. 4,917,269, Moore et al., U.S. Pat. No. 5,058,772, and Reiber et al., U.S. Pat. No. 4,671,421.

SUMMARY OF THE INVENTION

The present invention is directed to a fitment and a bottle body and to the container including fitment, bottle body and/or closure which can minimize the amount of residual product which remains in the container once its contents have been substantially depleted. The fitment of the invention comprises an outer wall, a bottom wall and a pour spout extending upwardly from the bottom wall. The outer wall includes a vent hole which also acts as a product exit aperture, preferably spaced from the bottom wall when the bottle is nearly fully inverted. More preferably, at least 40% of the area of the product exit aperture is contained within an upper half of the outer wall, still more preferably at least 50% of the area, more preferably at least 70% of the area and most preferably at least 80% of the area is contained within the upper half of the outer wall. If desired, additional product exit apertures may be present. Generally, it will be desirable that the bottom wall itself includes one or more product drainage apertures.

In accordance with the invention, a bottle body is provided which extends upwardly from a base and ends in a bottle finish. The finish includes one or more inner locking surfaces disposed to abut the outer wall of the fitment and an inner channel in one or more of the locking surfaces which is positioned to lead product which is disposed between the outer wall of the fitment and inner aspects of the finish when the container is inverted, to the product exit aperture and then out of the bottle and or directly out of the bottle. In one embodiment, the channel extends to the level of the product exit aperture, e.g. to the level of the top end (when the bottle is inverted) of the product exit aperture. Alternatively, the channels in the locking surfaces can extend through the locking surfaces to the exterior of the container. By use of a channel, it is possible for most of the last remnants of product to be poured from the container when it is in an inverted position, notwithstanding the abutting locking surface(s) on the finish which would otherwise tend to block or severely limit egress of residual product from the container. Since the fit between the locking surface(s) and the outer fitment base is not liquid-tight, the channel is particularly useful for promoting egress from the container of product trapped, or which would otherwise be trapped, between the locking surface(s) and the outer wall of the fitment.

Both the finish channel and the product exit aperture may advantageously be tapered at an upper end to promote egress of the product from the container. The container of the invention is especially suitable for containing or for housing liquid consumer products such as heavy-duty liquid detergents and liquid fabric softeners.

In alternative embodiments, the channel may instead be present in the outer wall of the fitment and may also be tapered.

In accordance with another aspect of the invention, the threads on the outside of the container finish may be interrupted along a vertical line parallel to the longitudinal axis of the container to make room for a linear protuberance on the outside of the finish which may be formed during formation of the channel in the inside of the finish. The protuberance is preferably shallow to avoid interference with the cap threads. The protuberance may be situated at the parting line of the bottle.

For a more complete understanding of the above and other features and advantages of the invention, reference should be made to the following detailed description of the preferred embodiments and to the accompanying drawings.

DETAILED DESCRIPTION OF THE INVENTION

Figure 1:
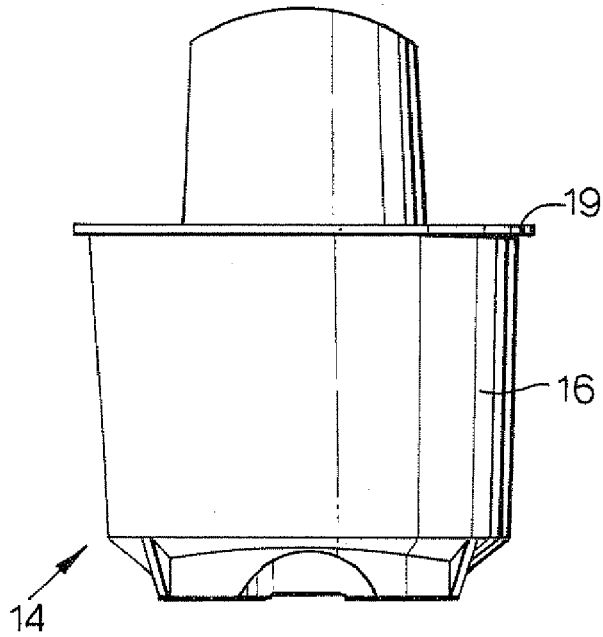
FIG. 1 is a front elevational view of the fitment of the invention.
Figure 2:
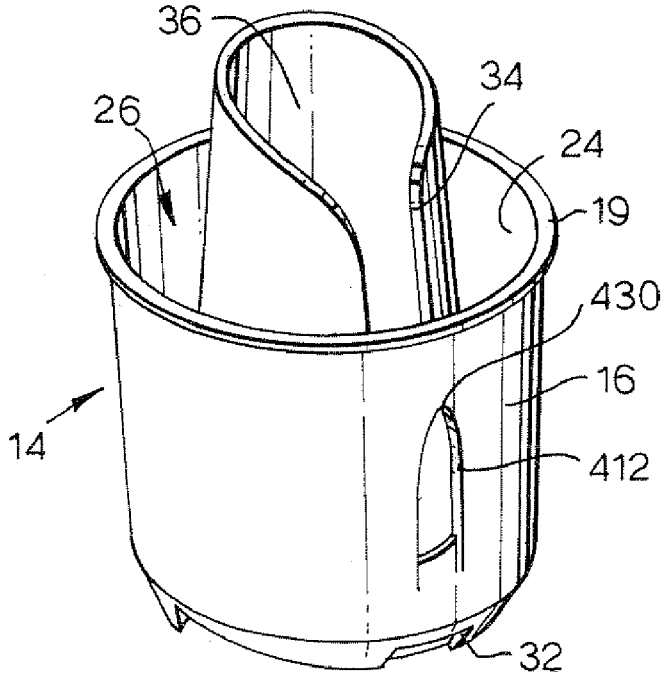
FIG. 2 is a rear perspective view of the fitment of the invention.
Figure 3:
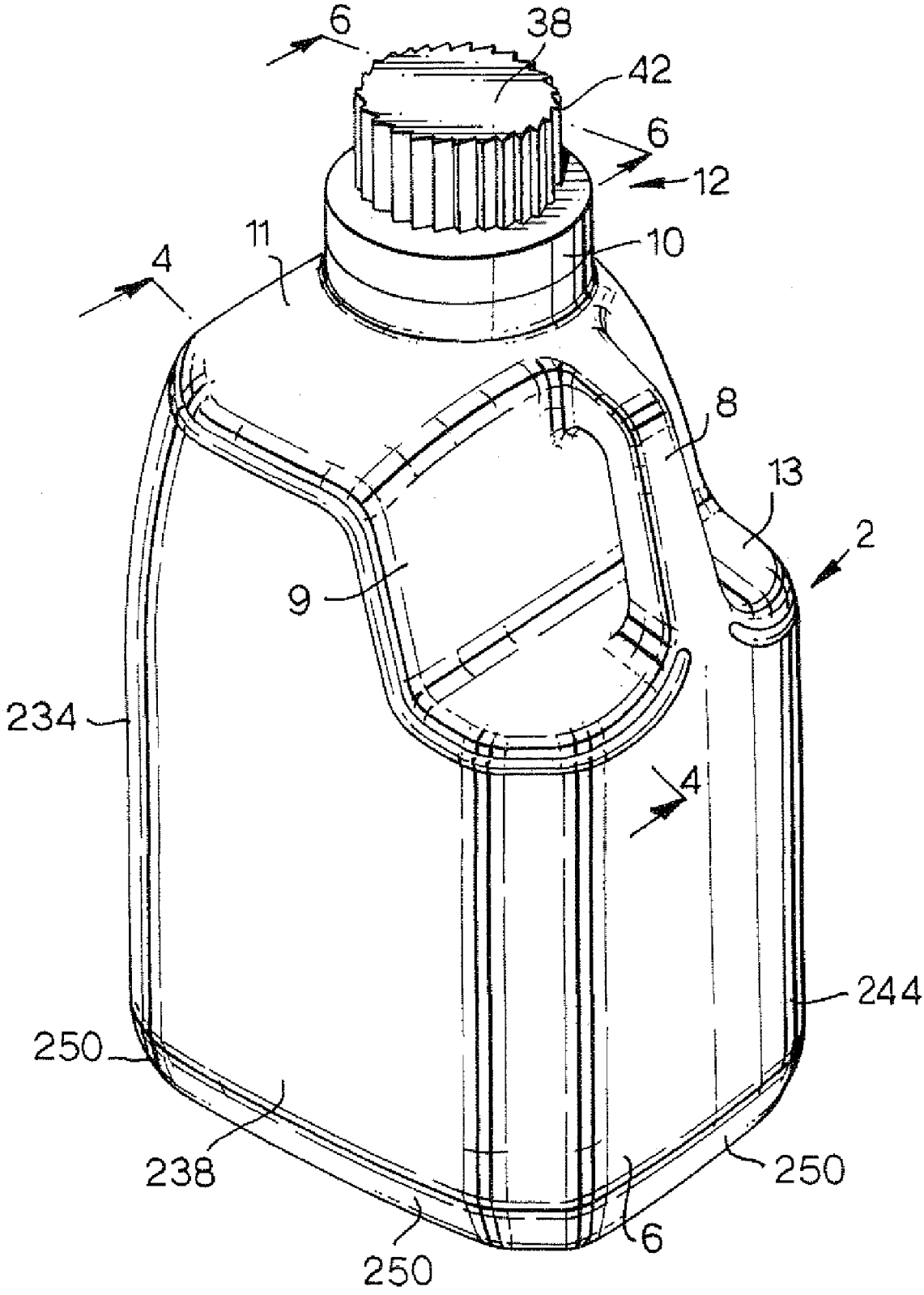
FIG. 3 is a perspective view of the container of the invention.
Figure 4:
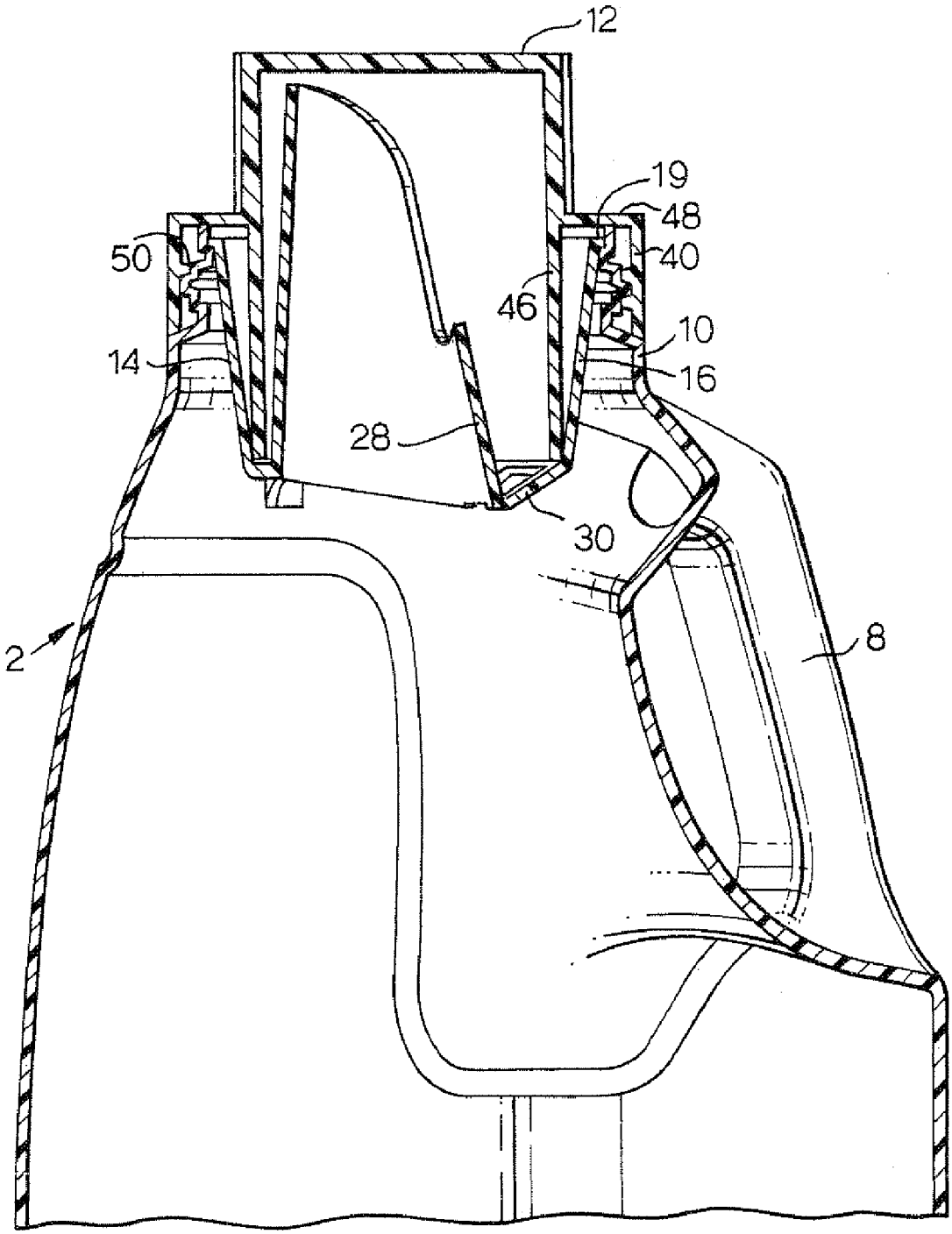
FIG. 4 is a cross section along the lines 4—4 of FIG. 3.

Referring now particularly to FIGS. 3 and 4, there is shown a container 2 including a bottle 6 having an integral handle 8 and a neck 10. The container 2 also includes a drainback fitment 14. Fastened to the top of the container 2, as viewed in FIG. 3, there is a closure or cap 12. All of the foregoing components are preferably molded from a resilient flexible plastic material. The materials may be selected so that the plastic from which the drainback fitment 14 is molded is softer than the materials from which the bottle 6 and closure 12 are formed. Alternatively, the drainback fitment may be made of a material of comparable hardness to that of the polypropylene of which the closure is generally made, e.g., LDPE (or HDPE).

The drainback fitment has an outer, frustoconical wall portion 16 which gradually tapers downwardly and inwardly and is received within the neck 10 of the bottle 6. The wall portion 16 terminates at its upper end in an annular rim 19. Rim 19 is generally flat.

Figure 9:
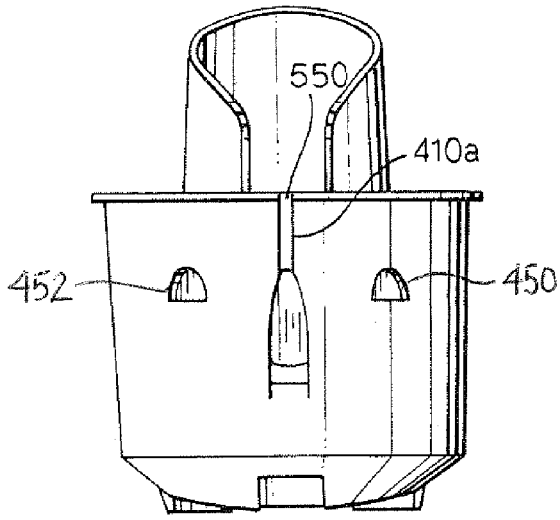
FIG. 9 is the same view as FIG. 8, except that a further alternate embodiment is illustrated.

The surface of the rim turns downwardly and inwardly to form the outer wall 24 of a circumferential well 26 surrounding a generally frustoconical, eccentrically positioned (off-center) spout 36, the lower periphery of which forms the inner wall 28 of the circumferential well 26. Between the outer wall 24 and inner wall 28 of the circumferential well 26 there is a sloping floor, bottom wall 30. The outer surface of wall 16 optionally includes a retaining ring which is spaced from and generally concentric with rim 19. Wall 16 includes a product exit aperture 412 (or drain port) located above and spaced from product drainage aperture 32 in bottom wall 30. Product exit aperture 412 serves to permit residual amounts of product caught between the finish or neck of the container and the outer wall of the fitment when the bottom is in the inverted (pouring) position to exit the container through the fitment. Product exit aperture 412 is tapered at 430 to promote egress of the product. The basic features of the fitment, bottle finish and closure are as shown in FIG. 9 of Davidson et al. U.S. Pat. No. 5,108,009, the disclosure of which patent is hereby incorporated by reference herein. An appropriate product drainage aperture is illustrated in more detail in FIG. 3 of Davidson et al.

The product drainage aperture or notch 32 preferably comprises a substantially rectangular notch formed in the lowest and widest portion of the floor 30 and is desirably in alignment with a longitudinal slot 34 which extends from the top of the rear of the spout. While the longitudinal slot may extend to the notch 32 and merge therewith, if desired, the slot may extend only approximately halfway down the length of the spout.

The spout may include projections to keep the fitments separated during stacking. Such projections may also serve to prevent rotation of the spouts during stacking when combined with lugs (not shown) depending from the bottom of the fitment and situated so that they block radial movement of the stacking projections on the next lower fitment when the fitments are stacked.

Notch 32 and longitudinal slot 34 provide a path for residual liquid remaining on the spout 36 or closure 12 to drain back into the bottle 6 either directly or via the downwardly sloping floor 30 of the circumferential well 26 under the force of gravity when the container 2 is in an upright position.

Fitment 14 is secured to bottle finish 68 by a friction fit and is vertically positioned by resting on an inner bottle ledge. Bottle finish 68 includes an annular mouth 70, and a locking ridge 72. The finish includes external threads 74. The fitment is inserted into the bottle by forcing it through the opening at the bottle mouth and pushing it until annular rim 19 of the fitment is situated upon or above locking ridge 72. If rim 19 is above locking ridge 72, preferably it is immediately above. In this position, the distal end of the annular rim will be adjacent to bottle mouth 70. Optionally, a retaining ring of the fitment helps to retain the fitment in position by abutting the lower aspects of locking ridge 72.

Figure 5:
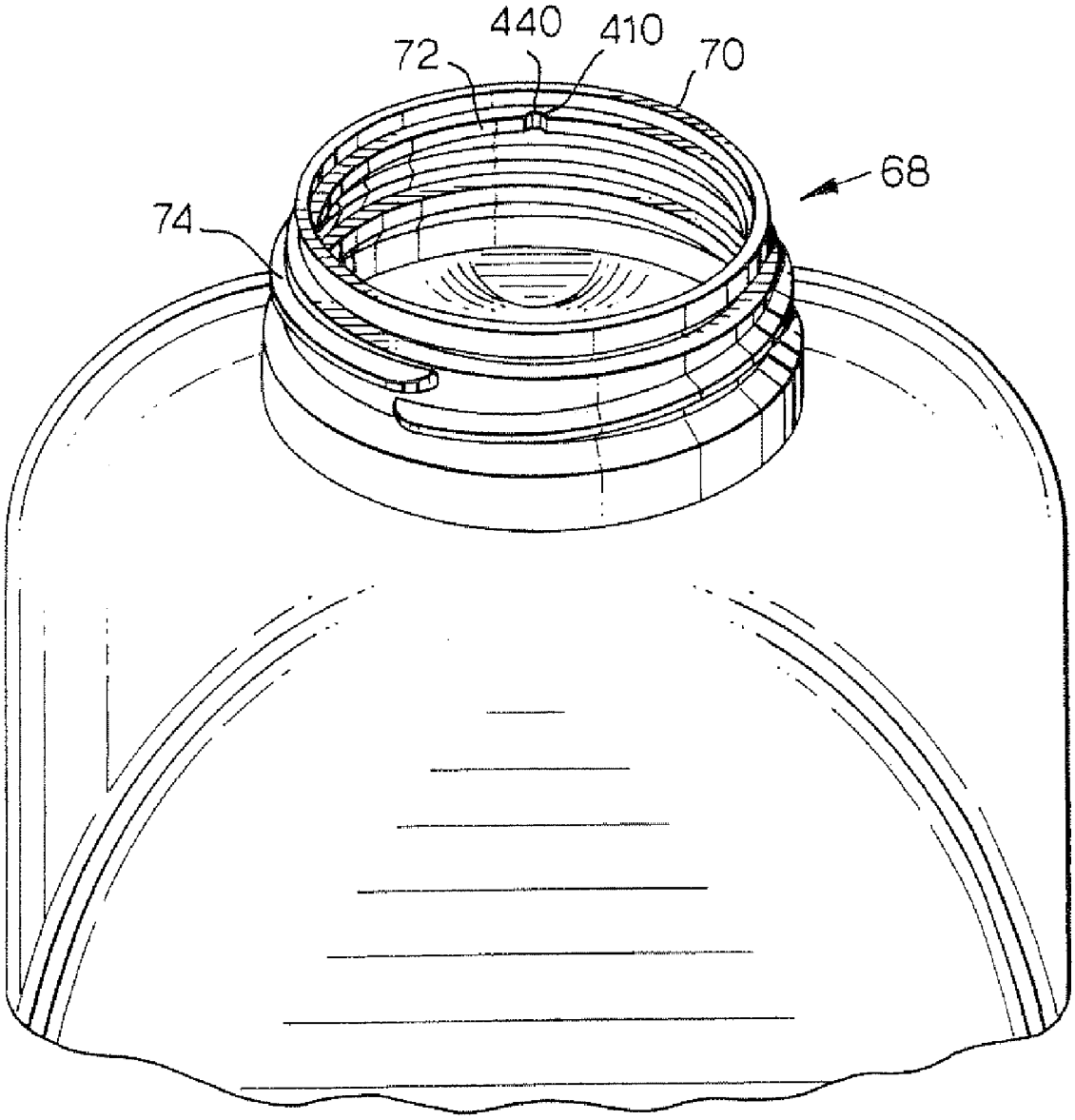
FIG. 5 is a front perspective view of the container with the fitment removed.
Figure 6:
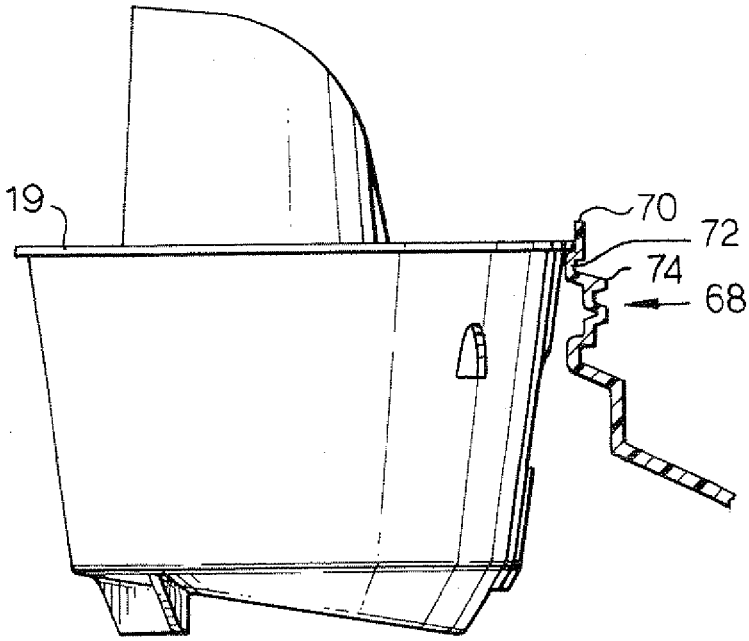
FIG. 6 is a cross section along the lines 6—6 of FIG. 3.
Figure 13:
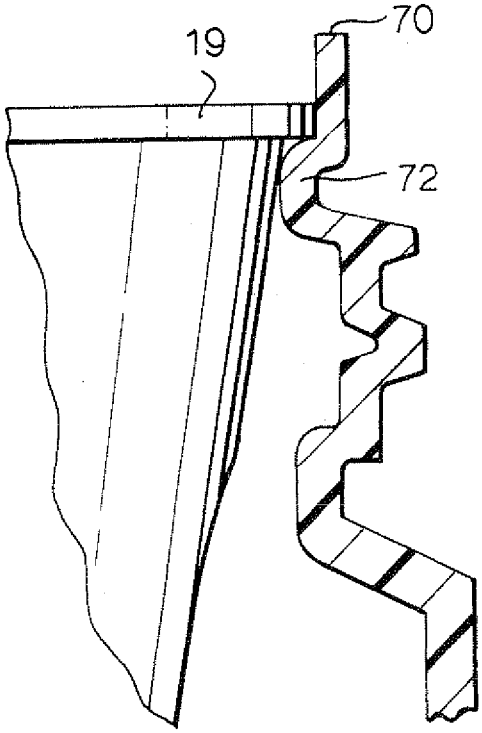
FIG. 13 is an enlarged version of a portion of FIG. 6
Figure 7:
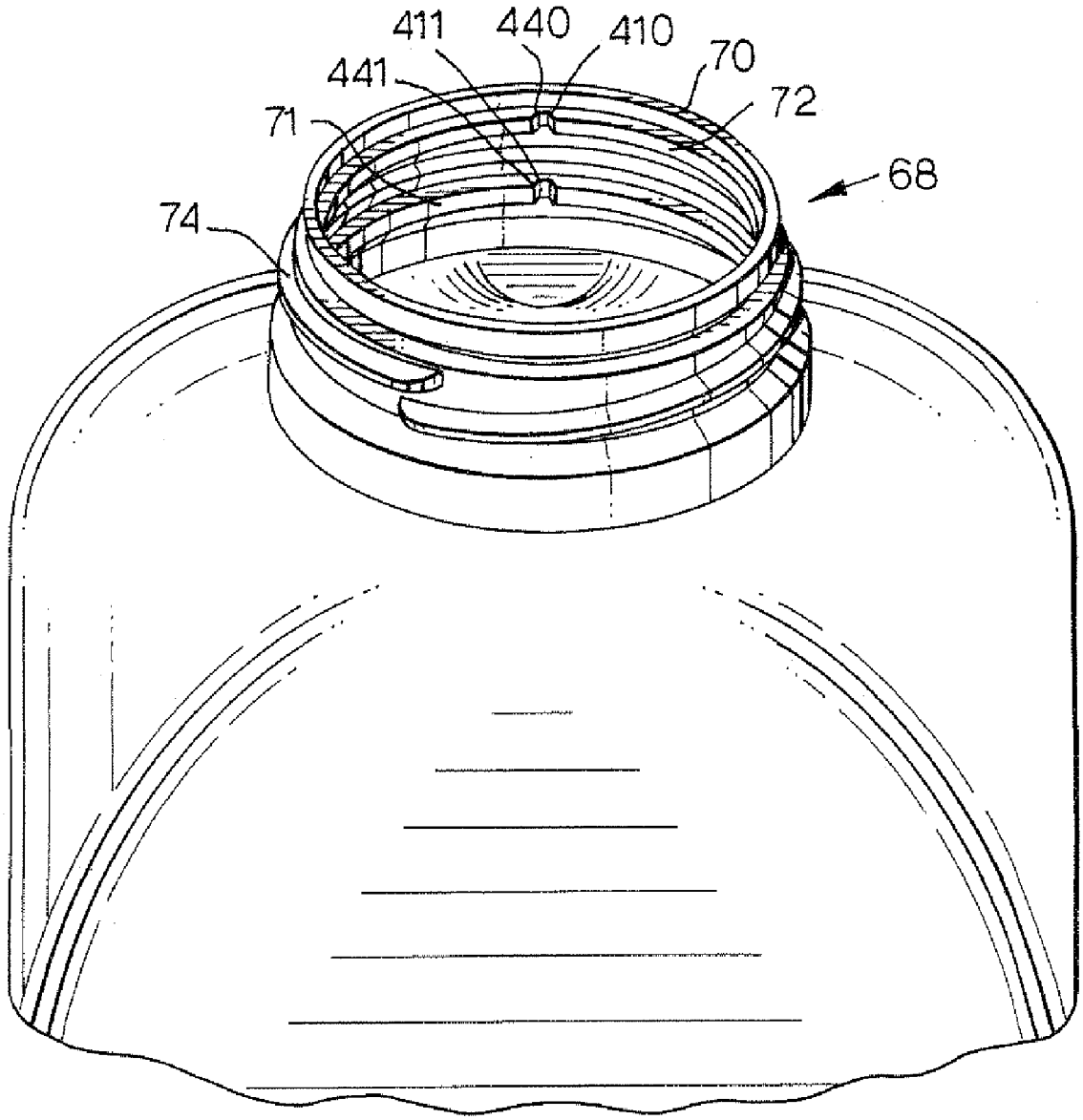
FIG. 7 is the same view as FIG. 5, but of an alternate embodiment.
Figure 8:
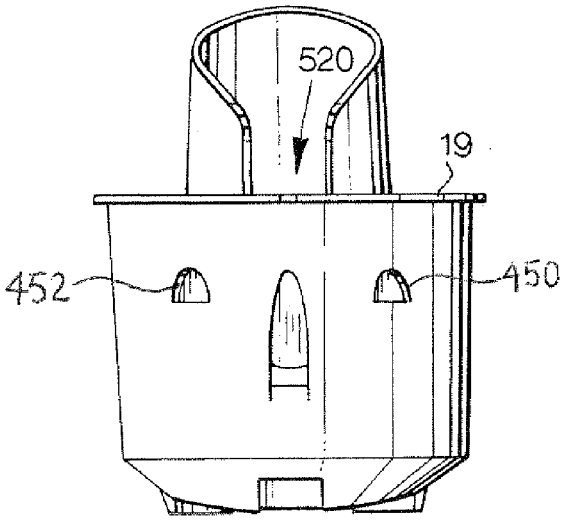
FIG. 8 is a rear perspective view of an alternate fitment.
Figure 11:
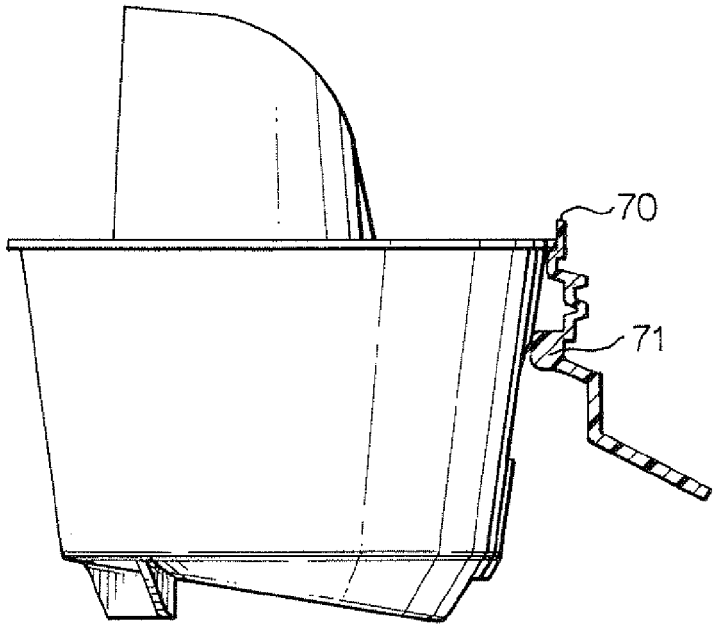
FIG. 11 is a cross section similar to FIG. 4, except that the closure and extraneous portions or the container have been removed.
Figure 12:
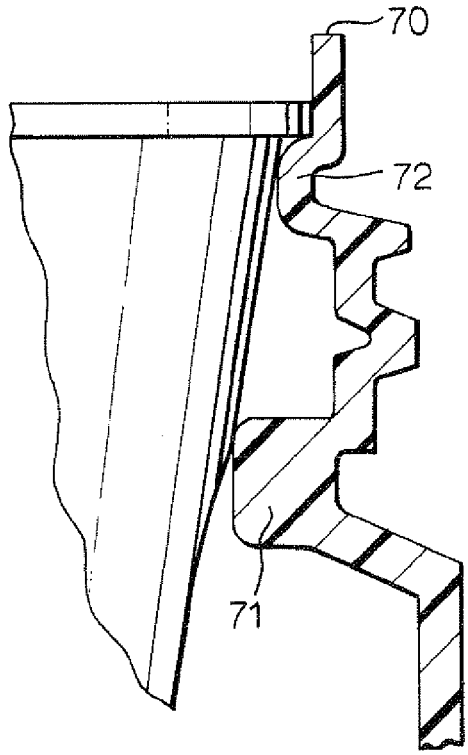
FIG. 12 is an enlarged version of a portion of FIG. 11.

As seen in FIGS. 5 and 6, in accordance with the invention, channel 410 extends through locking ridge 72 to permit egress of residual amounts of liquid product from the container from between the fitment and the finish through the channel and out the container. If desired or necessary to facilitate egress of product, rim 19 may include a discontinuity 520 (FIG. 8) aligned with channel 410. Alternatively, as seen in the alternative embodiments of FIGS. 7, 11 and 12, the finish includes a second locking ridge 71 having channel 411 extending through it. Product trapped between the finish 68 and outer wall 16 of the fitment travels through channel 411 and exits through the product exit aperture or continues through to channel 410 and exits the container through discontinuity or channel 520 in rim 19. The optional tapering at the upper ends 440, 441 of channels 410, 411 promotes controlled exit of the product from the container. Where the optional retaining ring is present on the fitment outer wall at the level of the product exit aperture, the ring may be interrupted at the level of the aperture.

Figure 10:
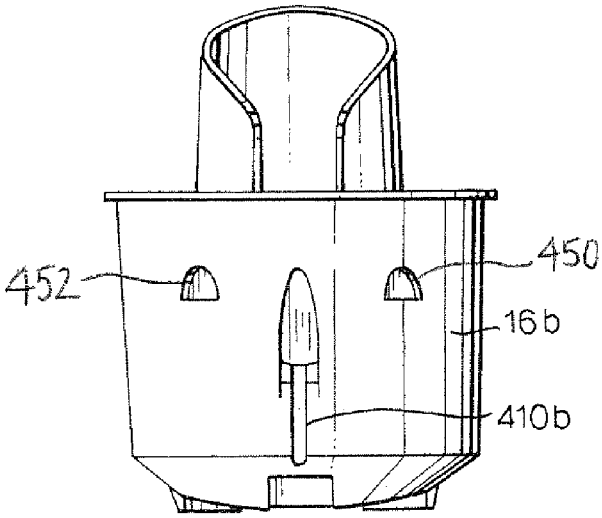
FIG. 10 is the same view as FIG. 9 except that a still further alternate embodiment is illustrated.

Further alternative embodiments are illustrated in FIGS. 9 and 10 wherein channels 410*a* and 410*b* are formed in the outer fitment walls and extend respectively from the upper end of the product exit aperture to the top of the fitment (FIG. 9) and from the bottom of the fitment wall 16*b* to the bottom of the product exit aperture. Rim 19*a* (FIG. 9) is interrupted at 550 to promote egress of fluid from an inverted container.

If desired, the spout 36 may be provided with an anti-drip lip. Also, it may be desirable to provide the spout with a V-shaped pouring angle for improved control of pouring of the product.

The drainback fitment 14 may be formed from a thermoplastic such as high density polyethylene. Or it may be made of a polyethylene which is a product of a 50:50 blend of a high density resin and a low density resin. The high density resin can be U.S.I. LS 506 or a similar resin. The low density resin can be U.S.I. LS 208 or the like. Instead of a mix of resins, a low density polyethylene such U.S.I. 241 or even a harder material such as polypropylene may be used to form the fitment. Other plastic resins having chemical and physical properties similar to the aforementioned resins can be used in fabricating the drainback fitment 14.

Preferably, the container of the invention provides the spout and drainback area in the form of the above described fitment, separate from the body of the bottle. In the described preferred embodiment, the fitment snaps into the container finish so that a friction fit is obtained between the outer wall of the fitment and the locking ridge on the inside of the container finish. A fitment may also be provided in other ways, eg it may be applied by spin welding, or by hot melt adhesive or by the EMABOND system. An internally threaded finish may be combined with an externally threaded closure.

The EMABOND system employs a thermoplastic gasket impregnated with metal particles. When the gasket is in position (between a sealing area ridge of the fitment and inside bottle neck ledge), a sealing unit with an electromagnetic force presses down on the fitment and heats up the metal particles, thereby melting the plastic gasket, and the compression welds the two components together with a leak-proof seal.

It is also contemplated that some of the embodiments may be in the form of refill bottles which contain a plain screw cap and no spout but which are capable of receiving a transferable spout and self draining closure.

The closure 12 has a closed end 38 at its top which is merged at its circumference with a downwardly extending inner circumferential wall 46 having a surface onto which there are integrally molded gripping teeth 42 biased to present greater friction to the hand when the closure 12 is rotated counterclockwise to loosen it than when it is rotated clockwise for tightening. Alternatively, other gripping means, such as vertical ribbings may be employed.

The inner circumferential wall 46 is concentric with and spaced from an outer circumferential wall 40. Inner circumferential wall 46 extends downwardly beyond the length of the outer circumferential wall 40. The inner circumferential wall 46 and the undersurface of the closed end 38 form a cup for measuring the contents of the container 2 as it is poured from the bottle 6. A fill line can be molded into the inner circumference of the inner wall if desired. Internal vertical lines closely spaced together can be provided to enhance the visibility of the fill line.

The outer circumferential wall 40 and inner circumferential wall 46 are connected by a web 48 so that a downwardly facing (when the closure 12 is fastened to the bottle 6) channel is defined between the inner circumferential wall 46 and the outer circumferential wall 40. The channel is optionally lined with a liner preferably made of a resilient, polymeric material. However, it is preferred that the channel be linerless. The channel in cooperation with the frustoconical wall portion 16 and optional liner serves as a trap for preventing residual contents of the container 2 from migrating to the junction of the closure 12 and neck 10 of the bottle 6. If desired, the liner may be omitted.

Complimentary fastener means in the form of threads are provided on the closure 12 and neck 10 of the bottle 6 at their juncture. The closure 12 has internal threads 50 which mate with external threads 74 on the finish 68 of the bottle. As the closure 12 is threaded onto the neck 10 of the bottle 6, the liner, if present, engages the mouth 70 of the bottle 6 thereby sealing the bottle to prevent leakage of the contents from the container. When the liner is omitted, the top of the channel seals against the mouth 70 of the bottle. The presence of the fitment rim below the top of the finish permits the closure (or the liner of the closure) to form a seal at one circumferential location at the top of the finish. If the fitment rim extended over the top of the fitment there would be two areas for liquid product to escape through the seal, above and below the rim of the fitment.

The inside of the land of the bottle may be beveled to assist in sealing. The bevel imparts to the top of the mouth a sharp point from which the inner wall of the mouth slants inwardly. The outer wall of the mouth is disposed generally vertically. Whether the closure is on or off, the friction fit of fitment 14 against locking ridge 72 within the bottle finish 68 impedes escape of the product except through the spout, the drainage aperture, the product exit aperture or the channel. When the closure is screwed closed, product which has exited bottle 6 through the spout, drainage aperture, the channel or the product exit aperture is contained within container 2 by the closure.

As is apparent from FIG. 4, except for the spout, fitment 14 is wholly contained within the bottle 6. The entire outer wall 16 is situated below the mouth 70 of this bottle.

Although the fitment herein has been described as having a single product exit aperture, a plurality of apertures, e.g., 450 and 452, may be utilized.

In addition to serving to permit use of the last remnants of the product, the product drainage aperture also serves as a vent hole as well. As such, it permits air to enter the container as product leaves through the spout.

The product exit aperture may assume any shape and size suitable for permitting exit of at least a portion of the last fraction of product trapped between the outside of the fitment and the wall of the bottle, e.g. triangular, rectangular or square, or may take the form of a slit. Preferably, the exit aperture is of a size and shape suitable for venting, as well. The product exit aperture is located high enough in the fitment wall such that at least a portion of liquid trapped when the bottle is turned upside down can escape. The product exit aperture is illustrated herein as occupying the middle half of the height of the fitment outer wall, and as being positioned approximately halfway down the wall of the fitment, although it may be located one quarter of the way down or three quarters of the way down or elsewhere, depending on the dimensions of the container.

While certain features such as the annular rim and the retaining-ring have been illustrated and/or described as extending 360 degrees around the circumference of the fitment, it will be apparent that such will not always be necessary in order that their functions be fulfilled in accordance with the invention. For instance, the annular rim may be replaced by other stopping means and the retaining rim may be replaced by other retaining means. Stopping means refers to the annular rim and equivalent structures even in fitments and containers wherein the friction fit between the fitment wall 16 and the locking ridge 72 is sufficient to prevent the entire fitment from being pushed through and into the bottle.

The closure may be formed of a harder material than that used in the drainback fitment 14. In the preferred embodiment of the invention, the plastic material from which the closure 12 is molded is a homopolymer or copolymer polypropylene such as that sold by Phillips Petroleum Company under the designation Phillips HLV 120-01.

The bottle 6 also may be formed of a material that is harder than the material employed in the drainback fitment 14. Alternately, the fitment may be formed of a harder material, as where the fitment is fabricated from polypropylene. Materials from which the bottle may be fabricated include high density polyethylene. Or, another resin sold by U.S.I. under the designation 0.955 density, OI-388-2, is a suitable material. Other materials exhibiting similar chemical and physical properties can be substituted. Preferably, however in accordance with certain embodiments of the invention, the bottle is made from multiple layers.

The bottle of the invention preferably is made of at least one resin layer, especially the inner layer, which possesses a good stress crack resistance, as determined according to ASTM D-1693-95. That is, the layer preferably has at least 75 hours, and more preferably at least 100 hours, most preferably at least 300 hours stress crack resistance under that test. Good stress crack resistance is promoted by the selection of resins having an appropriate distribution of chain lengths, especially distributions favoring long chain lengths. Stress crack resistance is important to the ability of the package to contain effectively its contents for prolonged periods of time on the shelf or in the consumer's cupboard. Polymer layers which have a lower MI (lower melt index) promote stress crack resistance, since they tend to have longer molecular chain lengths, and impact resistance, as well.

Preferably, the container also possesses a good drop strength resistance so that a water filled bottle will survive at least one 3-foot drop onto its base. The drop strength can be important to assure that the container can withstand the travails of packing, shipment, and use and storage by the consumer.

The finished end or body of the bottle is preferably lightweighted. That is, the finished end or body is made of a material which is lighter in weight than standard materials from which heavy duty liquid detergent bottles are made. This permits less material to be used and results in less material to be disposed of after the contents of the bottle have been consumed. A lightweight bottle is described in Giblin et al., Ser. No. 08/777,641, the disclosure of which is incorporated by reference herein.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A container comprising:

(a) a fitment including
  (i) an outer wall having a top and a bottom,
  (ii) a bottom wall extending inwardly from the bottom of said outer wall, and
  (iii) a pour spout extending upwardly from said bottom wall, (b) a bottle base, (c) a bottle body extending upwardly from said bottle base to a bottle finish, (d) said finish including an inner wall including a first locking surface abutting said outer wall of said fitment, (e) said fitment outer wall and finish inner wall forming a reservoir entrapping fluid product when said container is inverted, (f) said fitment outer wall including a first product exit aperture, (g) said first finish locking surface including a first channel extending through said locking surface and leading from said reservoir toward an exit from said bottle.

2. The container according to claim 1 wherein said first channel leads to said first product exit aperture.

3. The container according to claim 1 wherein said fitment bottom wall includes a product drainage aperture.

4. The container according to claim 1 wherein said first finish locking surface is an inwardly extending locking ridge which frictionally abuts said fitment outer wall.

5. The container according to claim 2 wherein said product exit aperture is tapered toward a top end of said outer wall.

6. The container according to claim 1 wherein said first finish channel is tapered toward an upper end of said finish.

7. The container according to claim 2 further including at least one further product exit aperture in said fitment.

8. The container according to claim 2 further including second and third product exit apertures.

9. The container according to claim 1 wherein said fitment further comprises a generally annular rim extending radially outwardly from the top of said outer wall.

10. The container of claim 1 further comprising a closure having an end wall, an inner circumferential wall depending from said end wall, an outer circumferential wall concentric with and spaced from said inner circumferential wall a web parallel to and spaced from said end wall and connecting said inner and outer circumferential wall mating with outer threads on the finish.

11. The container according to claim 10 wherein said closure includes internal threads which mate with external threads on said bottle finish.

12. The container according to claim 9 wherein said rim includes an opening for liquid emerging from said channel.

13. The container according to claim 2 wherein said product exit aperture is spaced from said bottom wall.

14. The container according to claim 2 wherein said outer wall includes an upper half and a lower half and at least 40% of the area of said product exit aperture is container within the upper half.

15. The container according to claim 2 wherein said outer wall includes an upper half and a lower half and at least 50% of the area of said product exit aperture is container within the upper half.

16. The container according to claim 2 wherein said outer wall includes an upper half and a lower half and at least 70% of the area of said product exit aperture is contained within the upper half.

17. The container according to claim 2 wherein said outer wall includes an upper half and a lower half and at least 80% of the area of said product exit aperture is container within the upper half.

18. The container according to claim 1 wherein the bottle body is transparent or translucent.

19. The container according to claim 1 further comprising a second finish locking surface including a second channel leading toward the exterior of the container at the top of the bottle.

20. The container according to claim 1 wherein said fitment outer wall is generally annular.

21. A container comprising:

(a) a fitment including
  (i) an outer wall having a top and a bottom,
  (ii) a bottom wall extending inwardly from the bottom of said outer wall, and
  (iii) a pour spout extending upwardly from said bottom wall, (b) a bottle base, (c) a bottle body extending upwardly from said bottle base to a bottle finish, (d) said finish including at least one locking surface abutting said outer wall of said fitment, (e) said fitment outer wall including a first product exit aperture, (f) said finish locking surface including a channel extending through said locking surface and leading from a reservoir between said fitment outer wall and an inner surface of said finish to the exterior of said container at the top of the bottle.

22. The container according to claim 21 wherein said fitment bottom wall includes a product drainage aperture.

23. The container according to claim 21 wherein said finish locking surface is an inwardly extending locking ridge which frictionally abuts said fitment outer wall.

24. The container according to claim 21 wherein said product exit aperture is tapered toward a top end of said outer wall.

25. The container according to claim 21 wherein said finish channel is tapered toward an upper end of said finish.

26. The container according to claim 21 wherein said fitment further comprises a generally annular rim extending radially outwardly from the top of said outer wall.

27. The container of claim 21 further comprising a closure having an end wall, an inner circumferential wall depending from said end wall, an outer circumferential wall concentric with and spaced from said inner circumferential wall, a web parallel to and spaced from said end wall and connecting said inner and outer circumferential wall mating with outer threads on the finish.

28. The container according to claim 27 wherein said closure includes internal threads which mate with external threads on said bottle finish.

29. The container according to claim 21 wherein said product exit aperture is spaced from said bottom wall.

30. The container according to claim 21 further including at least one further product exit aperture in said fitment.

31. A container comprising:

(a) a fitment including
  (i) an outer wall having a top and a bottom,
  (ii) a bottom wall extending inwardly from the bottom of said outer wall,
  (iii) a pour spout extending upwardly from said bottom wall, and
  (iv) a generally annular rim extending radially outward from the top of said outer wall, (b) a bottle base, (c) a bottle body extending upwardly from said bottle base to a bottle finish, (d) said finish including an inner wall including a first locking surface abutting said outer wall of said fitment, (e) said fitment outer wall and finish inner wall forming a reservoir entrapping fluid product when said container is inverted, (f) said fitment outer wall including a first product exit aperture, (g) said first finish locking surface including a first channel leading from said reservoir toward an exit from said bottle, and wherein said rim includes an opening for liquid emerging from said channel.

32. A container comprising:

(a) a fitment including
  (i) an outer wall having a top and a bottom,
  (ii) a bottom wall extending inwardly from the bottom of said outer wall, and
  (iii) a pour spout extending upwardly from said bottom wall, (b) a bottle base, (c) a bottle body extending upwardly from said bottle base to a bottle finish, (d) said finish including at least one locking surface abutting said outer wall of said fitment, (e) said fitment outer wall including a first product exit aperture, (f) said finish locking surface including a channel leading from said reservoir to the exterior of said container at the top of the bottle; and (g) a second finish locking surface including a second channel leading toward the exterior of the container at the top of the bottle.

* * * * *